United States Patent [19]

Imaizumi et al.

[11] 4,065,120

[45] Dec. 27, 1977

[54] COPY PAPER STRIPPING MEANS

[75] Inventors: Masaru Imaizumi, Shinshiro; Syotaro Inagaki, Okazaki, both of Japan

[73] Assignee: Minolta Camera Kabushiki Kaisha, Osaka, Japan

[21] Appl. No.: 729,642

[22] Filed: Oct. 4, 1976

[30] Foreign Application Priority Data

| | | |
|---|---|---|
| Oct. 17, 1975 | Japan | 50-142045 |
| Nov. 5, 1975 | Japan | 50-151025 |

[51] Int. Cl.[2] ..... B65H 29/54

[52] U.S. Cl. ..... 271/174; 118/245; 271/DIG. 2; 271/80; 432/60

[58] Field of Search ..... 271/DIG. 2, 258, 262, 271/174, 80; 118/60, 245; 432/60; 34/120; 100/174

[56] References Cited

U.S. PATENT DOCUMENTS

| | | | |
|---|---|---|---|
| 3,820,776 | 6/1974 | Fujimoto | 271/80 |
| 3,844,252 | 10/1974 | Thettu | 432/60 X |
| 3,948,507 | 4/1976 | Stange | 271/174 |

*Primary Examiner*—Richard A. Schacher

*Attorney, Agent, or Firm*—Wenderoth, Lind & Ponack

[57] ABSTRACT

Slidably and pivotally mounted means for stripping copey paper from one or both rolls of a fuser assembly in a photocopying machine. Spring means urging the stripping means into contact with a roll is normally countered by a component of frictional force exerted by the roll on the stripping means, thereby avoiding exertion of undue pressure on the roll. If copy paper becomes adhered to and cannot be detached in a normal manner from the roll, the stripping means is moved to a position in which the tip portion thereof no longer contacts the roll, thereby avoiding damage to the roll and stripping means.

14 Claims, 12 Drawing Figures

COPY PAPER STRIPPING MEANS

Figure 1:
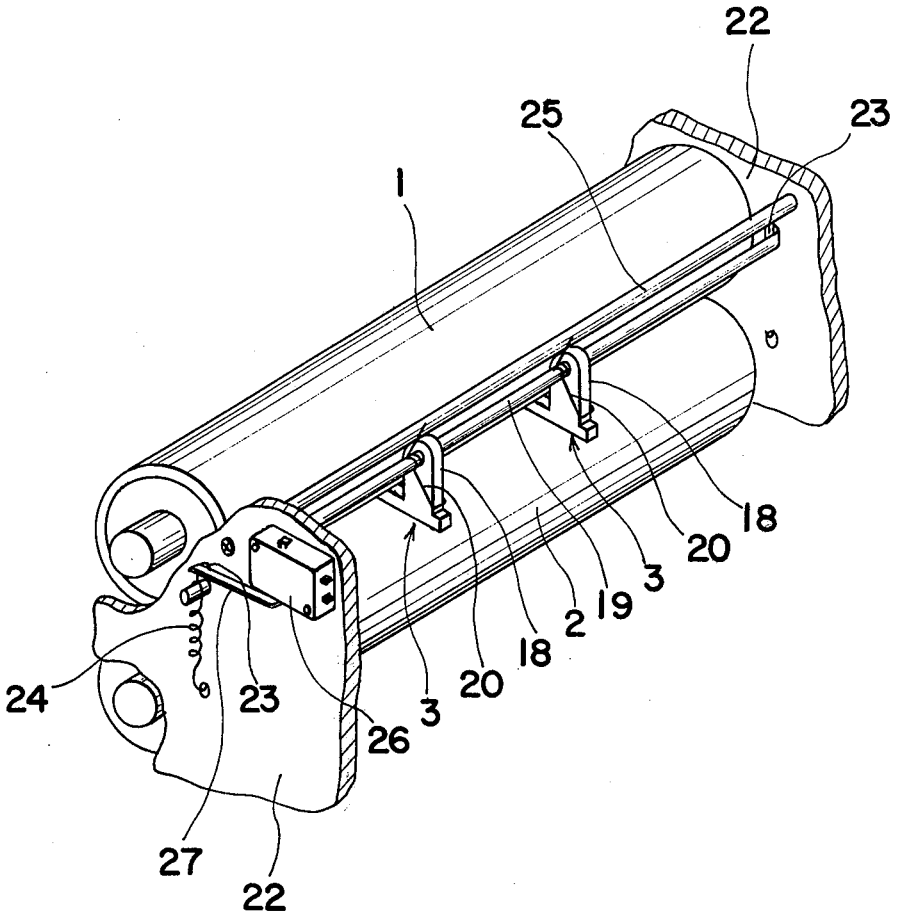

The present invention relates to a means for stripping copy paper from a movable element such as a photosensitive drum, a heating roll or similar roll means employed in a photocopying machine or electrophotographic copying machine. More particularly the invention relates to a copy paper stripping means which eliminates risk of damage to stripper elements or said movable element surface. Generally, in an electrophotographic copying machine, especially, in a copying machine of image transfer type an electrostatic latent image corresponding to the content of the original document is formed by means of exposure after charging on a photosensitive drum, and, after said latent image is developed with toner particles a copy paper is transported to said photosensitive drum in contact with the toner image thereof in order to transfer the toner image to the copy paper. During the transportation of the copy paper in contact with the toner image the toner image is transferred from the surface of said photosensitive drum to the copy paper by a charge of electricity such as a corona charge. Since the copy paper to be transferred the toner image is electrostatically adhered to the surface of the photosensitive drum and transported together with the photosensitive drum, there is provided a stripping means for separating the copy paper from the surface of the photosensitive drum. Similarly, in a photocopying machine in which the electrostatic latent image is transferred to the copy paper instead of transferring the toner image and the toner image is fixed to the copy paper, it is necessary to provide a stripping means for stripping the copy paper from the surface of the photosensitive drum. Furthermore, in a photocopying machine in which a heating roll for fixing the toner image on the copy paper is employed, the toner image is fixed by pressing of the copy paper to the surface of the heating roll. Since the copy paper on which is to be fixed the toner image is transported together with the heating roll an adhesion of the melted toner particles occurs, and it is also necessary to provide a stripping means to strip the copy paper from the surface of the heating roll. These stripping means have disadvantages, for example that the surface of the photosensitive drum or the heating roll is damaged by the stripping means, the toner or latent image on the copy paper is caused to become disordered, and the copy paper becomes dirty.

There will be described hereinafter in detail a stripping means used in association with a heating roll. The toner particles are fused and fixed in place on the copy paper by simultaneous application of heat and pressure, commonly by passing the copy paper between a heating roll and a press roll, which together constitute a fuser assembly, the image-carrying surface of the copy paper usually being in contact with the heating roll, and the copy paper is then moved to the exterior of the photocopying machine, directly or after passing through other processing stages. Alternatively, the fixing process may be effected subsequent to transfer of the image-defining toner particles to a second sheet of copy paper. As copy paper leaves the junction of the press roll and the heating roll it tends to remain in contact with the heating roll, and to avoid this it is the practice to apply a metered quantity of fluid release agent, e.g., silicon oil, on the heating roll, or to constitute at least the outer peripheral surface of the heating roll of a material which has good characteristics as a release agent, for example material such as silicon rubber or fluoro-rubber.

However, since it has been found that employment of such release agent materials is insufficient to always guarantee detachment of copy paper from the heating roll, it is also the practice to include in a photocopying machine supplementary means which are provided adjacent to the exit of the press roll and heating roll and serve to strip copy paper from the heating roll. Examples of such means are suction means which act to pull copy paper from the heating roll, blower means which act to direct a flow of compressed air between copy paper and the heating roll, and mechanical means in the form of at least one stripper element which has a wedge shaped profile and is positioned to permit insertion of the narrow-end portion thereof between the copy paper and the heating roll. Of these various detachment means, the mechanical stripper element has the advantages that it has the simplest and most economical construction, and requires little space and no supplementary power supply.

It is known to position a stripper element so that the tip thereof is very close to, but not in actual contact with, the heating roll. However, it is found that when so positioned the stripper element is comparatively inefficient in effecting detachment of copy paper, and it is accordingly the practice to position the stripper element so that it actually contacts the heating roll. Although it is theoretically possible to maintain the stripper element in the requisite position by providing fixed support therefor, in practical equipment only a slight misalignment of the stripper element with respect to the heating roll can result in scoring of the heating roll and/or breakage of the stripper element. It is therefore the practice to provide the stripper element with a resilient, suitably spring-controlled, support means applying a certain amount pressure to urge the tip of the stripper element into contact with the heating roll surface. Although such an arrangement achieves improved detachment of copy paper from the heating roll during normal functioning of the photocopying machine, maintaining the stripper element constantly in contact with the heating roll gives rise to a particular problem in conventional equipment. As is known, there may occur in a portion of the photocopying machine a fault, such as application of excessive pressure by the press roll in a fuser assembly or application of excessive heat by the heating roll, which results in such firm adhesion of a sheet of copy paper to the heating roll that the copy paper cannot be detached from the heating roll in a normal manner by the stripper element. In this case, as the heating roll rotates with the copy paper still attached thereto the leading edge of the copy paper is blocked by the tip of the stripper element maintained in contact with the heating roll, and as the heating roll continues to rotate, the remainder of the copy paper still being moved through the press roll and heating roll pushes strongly against the leading edge of the copy paper, and the leading edge in turn forces the stripper element tip into very firm contact with the heating roll, resulting in heavy damage both to the heating roll and to the stripper element.

Another problem which must be resolved in providing resilient support for the stripper element is the necessity of applying sufficient pressure to maintain the tip of the stripper element in contact with the heating roll in order to effect efficient detachment of copy paper but at the same time avoiding application of pressure liable to cause the stripper element to dig into the heating roll. To a certain extent pressure can be applied on the heating roll by providing the stripper element with a tip which as seen from above has a wide, generally square profile. However, a stripper element with such a tip has the disadvantage that the tip cannot always be inserted between the copy paper and the heating roll and detachment of copy paper by such a stripper element is much less efficient than detachment effected by a stripper element having a comparatively pointed profile.

A further problem is that as copy paper is being detached from the heating roll it is in sliding contact with an outer surface of the stripper element, and there is therefore the disadvantage that the copy paper tends to push the stripper element into firmer contact with the heating roll, and also that, even if application of this supplementary pressure is avoided, there is inevitably a tendency for toner particles to be removed from the copy paper, which can result in streaky or smudged portions in completed photocopies. In conventional equipment, the surface of the stripper element contacted by copy paper being detached from a heating roll is conparatively long, and there is accordingly greater risk of smudging of photocopies.

It is accordingly an object of the invention to provide a copy paper stripping means which effects efficient detachment of copy paper from fuser assembly roll means in a photocopying machine or electrophotographic copying machine but avoids damage to the roll means if copy paper is caused to adhere strongly to the roll means due to a fault in functioning of other portions of the photocopying machine.

It is another object of the invention to provide a resiliently supported copy paper stripping means in which tip portions contacting fuser assembly roll means are pointed, thus ensuring improved efficiency of copy paper detachment but which means is so disposed that the tip portions thereof, although maintained in constant contact with the roll means, do not apply pressure liable to result in damage.

It is a further object of the invention to provide a copy paper stripping means wherein tip portions contacting fuser assembly roll means are less subject than prior art means to pressure exerted thereon by a sheet of copy paper being detached from the roll means, and are less liable to remove toner particles from the copy paper.

In accomplishing these and other objects there is provided according to the present invention a copy paper stripping means comprising at least one stripper element which is pivotally and slidably mounted on a support shaft means and is normally urged by a spring means into a position in which the top thereof contacts the periphery of a roll constituting part of a fuser assembly in a photocopying machine or electrophotographic copying machine. During normal functioning of the photocopying machine the only movement of the stripper element is effectively pivotal movement with respect to the support shaft means. The stripper element and support shaft means are so constructed and mounted that when the stripper element is in a normal position contacting the roll a component of the frictional force exerted by the roll on the tip of the stripper element constitutes a counter force acting in a direction to move the stripper element tip away from the roll, whereby the stripper element is not pushed with excessive force by the spring means against the roll. Another component of this frictional force acts in a direction to move the pivotal center of the stripper element in essentially straight line movement towards the periphery of the roll, this being the direction in which the stripper element is slidably movable. The force exerted by this component is countered by the force of the spring means urging the stripper element into contact with the roll, or by another, separately provided spring means, and the component is not normally effective in causing movement of the stripper element. If, however, a sheet of copy is caused to adhere firmly to the roll because of a malfunction in the fuser assembly, for example, the force of the component is greatly increased, since the frictional force is greatly increased due to the strong pressure exerted by the copy paper on the top of the stripper element, as described above, with the result that the stripper element is momentarily pivoted about the tip thereof and is then rapidly swung into a position in which the tip thereof no longer contacts the roll. Movement of the stripper element tip out of contact with the roll is rendered even more rapid by a preferred form of stripper element comprising a rounded extension which is provided immediately to the rear of the tip thereof. When the stripper element tip contacts the roll the rounded projection is very close to but cannot contact the roll. However, when the stripper element commences to be moved towards the roll due to the above-described increase in frictional force, the rounded projection is immediately brought into contact with the roll and constitutes a pivot portion about which the stripper element may turn, and which, being rounded, does not exert concentrated pressure on the roll. Thus, the stripper means of the invention avoids risk of damage to photocopying machine elements both during normal functioning of the photocopying and when copy paper is firmly adhered to a fuser assembly roll because of photocopying machine malfunction.

According to different embodiments, of the invention there may be provided one or more stripper elements in association with each roll of a fuser assembly, and movement of the stripper elements caused by copy paper firmly adhering to a roll may cause actuation of an alarm to notify a user of the photocopying machine that a fault has occurred.

Also according to the invention, a stripper element preferably has a tip portion which is stepped with respect to the main portion of the stripper element and presents a smaller area for contact by copy paper being detached from a roll, whereby less pressure is exerted by the copy paper on the stripper element and there is less removal of toner particles from the copy paper.

Figure 2:
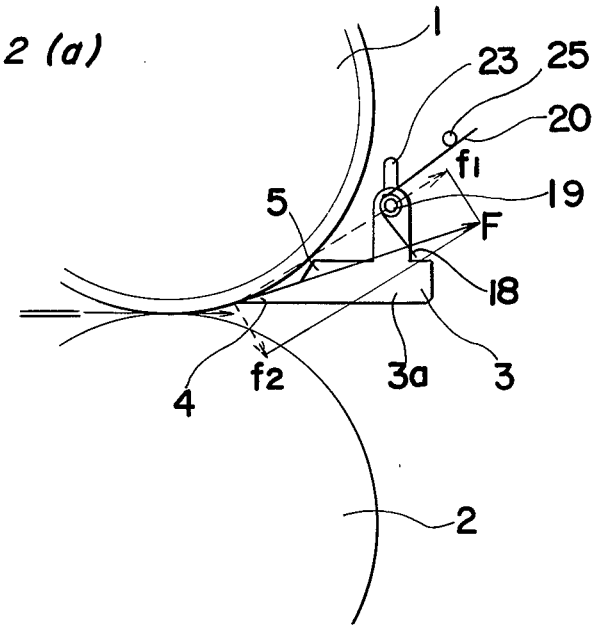
Figure 2:
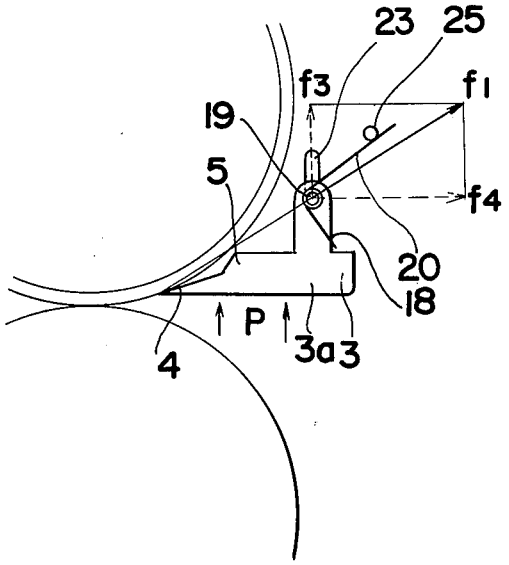
Figure 2:
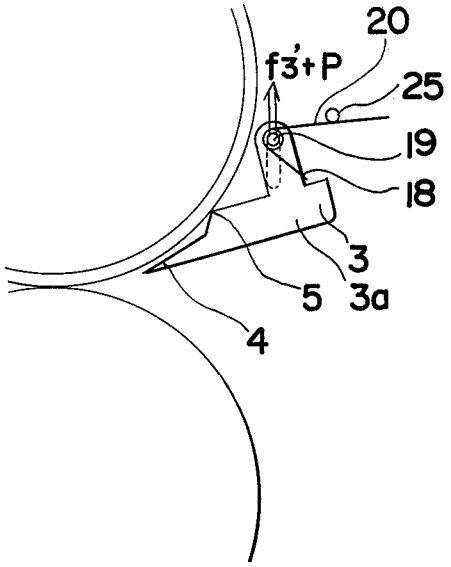
Figure 3:
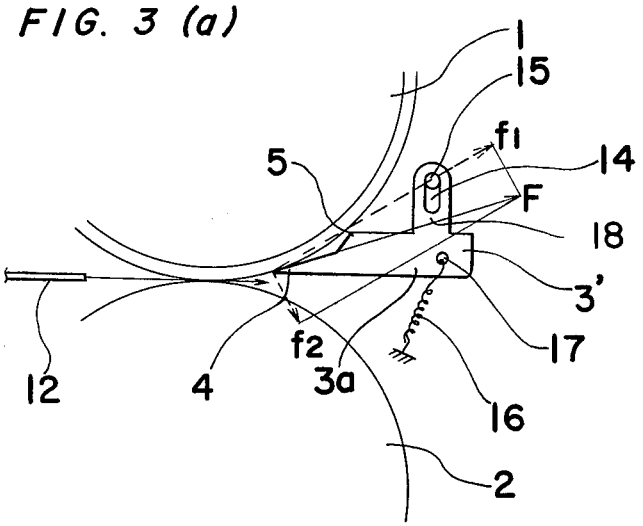
Figure 3:
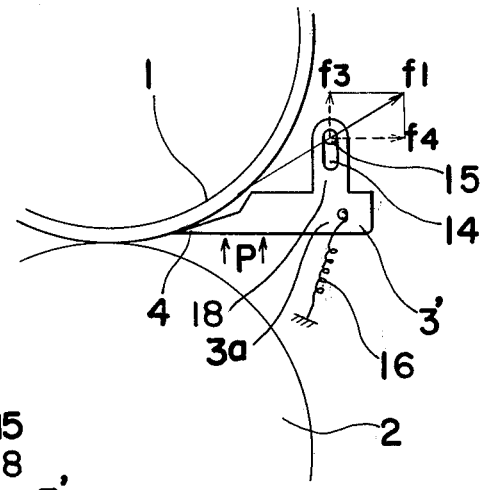
Figure 3:
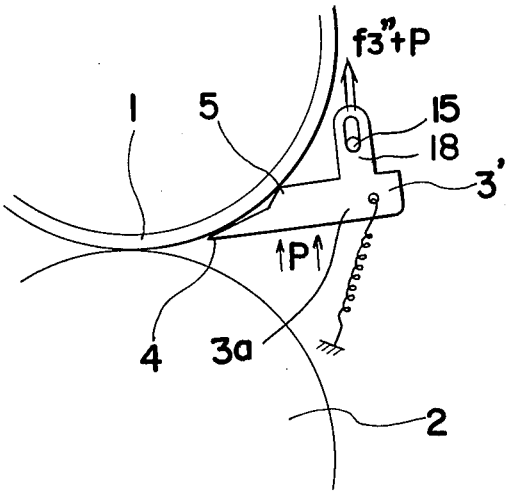
Figure 4:
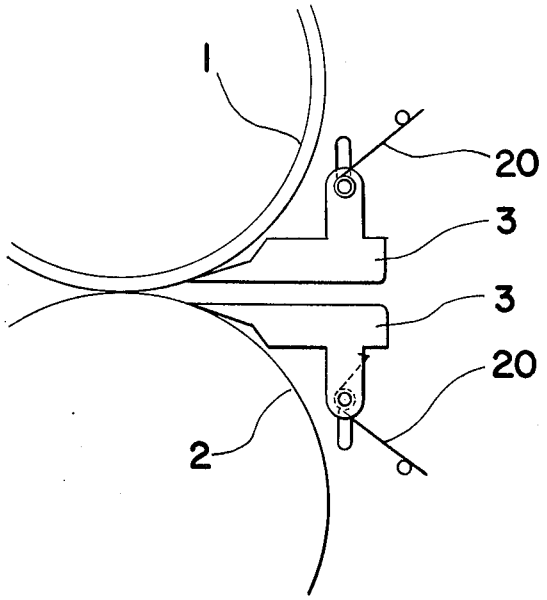
Figure 4:
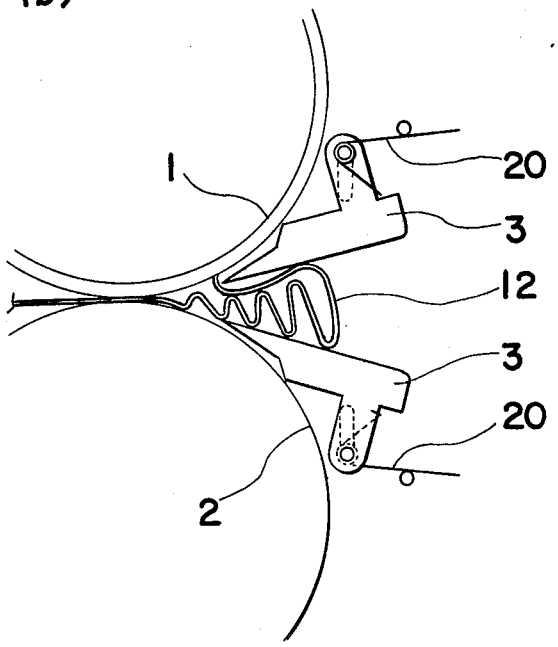
Figure 5:
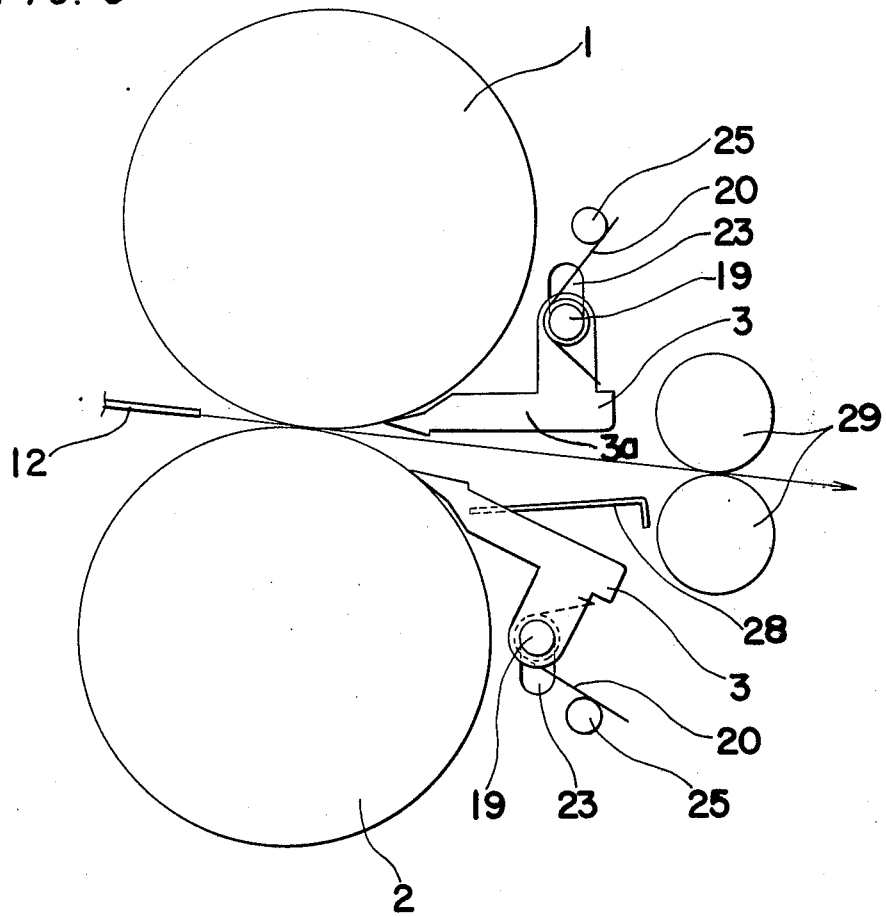
Figure 6:
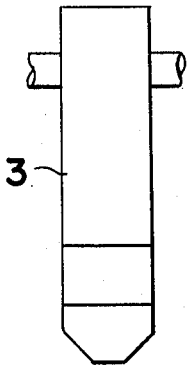
Figure 6:
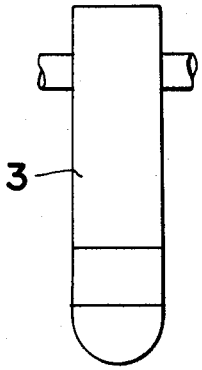

A better understanding of the present invention may be had from the following full description of several preferred embodiments thereof when read in reference to the attached drawings, in which like numbers refer to like parts, and FIG. 1 is a perspective view of an electrophotographic copying machine fuser assembly having associated therewith a copy paper stripping means according to a first embodiment of the invention;

FIGS. 2(*a*), 2(*b*), and 2(*c*) are schematic side views illustrating the action of the stripping means of FIG. 1;

FIGS. 3(*a*), 3(*b*) and 3(*c*) are detailed schematic side views of another embodiment of the invention;

FIGS. 4(*a*), and 4(*b*) are detailed schematic side views of another embodiment of the invention;

FIG. 5 is a detailed schematic side view of another embodiment of the invention having an improved contact tip design; and FIGS. 6(*a*), 6(*b*) are plan views showing preferred contact tip profiles.

Referring to FIG. 1, there is shown a toner fusing assembly comprising a heating roll 1 and a press roll 2 which are rotatably supported on opposed side walls 22 provided inside an electrophotographic copying machine. The heating roll 1 has associated therewith internal or external heater means, not shown, which heat the outer peripheral surface of the heating roll 1 to a temperature suitable to cause fusion of toner particles on a sheet of copy paper 12 which may be fed through the rolls 1 and 2. The press roll 2 is maintained in suitable pressure contact with the heating roll 1 by suitable spring means, not shown, and the axis of rotation thereof is vertically below that of the heating roll 1, feed of the copy paper 12 to and through the rolls 1 and 2 being along a generally horizontal line. Needless to say, other dispositions of the rolls 1 and 2 relative to one another are possible.

On the exit side of the rolls 1 and 2 there are provided two stripper elements 3 mounted on a support shaft 19. Each stripper element 3 has an upward extension 18 the upper end of which is rotatably but not slidably mounted on the shaft 19. The shaft 19 is disposed parallel to the axis of rotation of the roll 1 and has opposite ends extending through and slidably supported in elliptical slots 23 defined in the opposite side-walls 22. The slots 23 are each disposed in a generally vertical alignment and permit upward and downward movement of the shaft 19 and stripper elements 3 carried thereby, the shaft 19 being normally held in contact with the lower ends of the slots 23 by compression springs 24 each of which has a lower end attached to a side-wall 22 and an upper end attached to an end portion of the shaft 19.

One end of a pivotal actuation lever 27 extends across the upper end portion of one slot 23. If the shaft 19 is moved to the upper ends of the slots 23, as happens in a situation described in detail below, the shaft 19 causes the lever 27 to actuate a microswitch 26, which in turn actuates an alarm means.

Still referring to FIG. 1 and also referring to FIGS. 2*a*–2*c*, each stripper element 3 has a main body portion 3*a* disposed generally at right-angles to the upward extension 18 thereof, extends some distance forwards therefrom, i.e., towards the roll 1, and has a forward-end tip 4 which can contact the periphery of the roll 1 and be interposed between the roll 1 and a sheet of copy paper 12 which is exiting from the rolls 1 and 2 and is still in contact with the roll 1. The upper surface of the main body portion 3*a* between the tip 4 and upward extension 18 of each stripper element 3 has a rounded, upward extension 5 thereon. Each stripper element 3 is loaded by a wire spring 20 having a central portion wound around the support shaft 19. One end portion of each wire spring 20 presses against a fixed bar 25 which is higher than and parallel to the support shaft 19 and extends between and is supported by the side-walls 22, and the opposite end portion of each wire spring 20 presses against the rear side of the corresponding stripper element 3, i.e., the side of the stripper element 3 which is further removed from the roll 1. When the support shaft 19 is in its normal position contacting the lower ends of the slots 23, the wire springs 20 act to pivot the stripper elements 3 clockwise as seen in FIGS. 2*a*–2*c*, whereby the main body portions 3*a* of the stripper elements 3 are brought into a generally horizontal alignment, and the tips 4 thereof are brought into contact with portions of the peripheral surface of the heating roll 1 which are adjacent to, and on the exit side of the junction of the rolls 1 and 2. When the stripper elements 3 are thus positioned the rounded extensions 5 thereof do not contact the roll 1.

Referring more particularly to FIG. 2(*a*), for either stripper element 3, during rotation of the rolls 1 and 2, there is produced between the roll 1 and any point of the tip 4 of the stripper element 3*a* frictional force acting along a line F which is tangential to the periphery of the roll 1 at the point thereof contacted by the particular point of the stripper element tip 4. Since the tip 4 of each stripper element 3 has a definite width, in terms of the stripper element 3 as a whole the frictional force of course acts along a plane. However, for simplicity in the description below, only one point in this plane is considered, it being understood that the same description is applicable to the entire plane. Similarly, for brevity, only one stripper element 3 will be considered.

Still referring to FIG. 2(*a*), in its normal position, the support shaft 19 constituting the pivot point of the stripper element 3 is located intermediate the line of action of the frictional force F and the periphery of the roll 1, or, more precisely, between the line of action of the frictional force F and that portion of the periphery of the roll 1 which in terms of rotation of the roll 1 is in the fourth quadrant of the roll 1 periphery.

The frictional force F may be resolved into rectangular components *f*1 and *f*2, the component *f*1 exerting a force to press upward extension 18 of the stripper element 3 upward against the support shaft 19, and the component *f*2 exerting a force which tends to turn the stripper element 3 counterclockwise as seen in FIG. 2, that is, to cause the stripper element 3 to pivot in a direction in which the tip 4 thereof is moved away from the periphery of the roll 1. Although the spring 20 exerts sufficient force to constantly maintain the stripper element tip 4 in contact with the roll 1, the component *f*2 of the frictional force F is effective in preventing the tip 4 from being pressed with excessive force against the roll 1, since the pivot point of the stripper element 3 is located in the above-described position, and risk of damage to the tip 4 or roll 1 is thus avoided.

Referring to FIG. 2(*b*), the component *f*1 of the frictional force F may be regarded as being further resolved into rectangular components *f*3 and *f*4, component *f*3 acting vertically upwards and exerting a force to move the shaft 19 upwards along the slots 23, and the component *f*4 acting along a horizontal line and exerting a force to press the shaft 19 against the rear side surfaces of the slots 23. Despite the fact that the component *f*4 is at right-angles to the component *f*3 the component *f*4 counters the force of the component *f*3 since friction between the shaft 19 and inner surfaces of the slots 23, although small, is not zero. However, the main force countering the component *f*3 is the downwardly-acting force *f*3′ exerted by the springs 24 (FIG. 1), the force *f*3′ normally being sufficient to maintain the support shaft 19 in a lower most position in contact with the lower ends of the slots 23, as noted earlier.

If, however, a sheet of copy paper 12 fails to be detached from the roll 1 for some reason, then, since the copy paper 12 continues to be fed through the rolls 1 and 2, the leading edge of the copy paper 12 exerts considerable pressure to push the stripper element tip 4 into firmer contact with the roll 1, as indicated by the arrows P in FIG. 2(*b*), and also exerts thereon a force which acts in the direction of the frictional force F, this latter force being exerted by the portion of the copy paper 12 which is immediately adjacent to the heating roll 1 and is met directly by the outer edge portion of the stripper element tip 4. Thus, there is rapid increase in the frictional force F and sudden application of a supplementary force acting along the line of the frictional force F, and there is consequently considerable increase of the component *f*3, which now becomes sufficiently great to overcome the force *f*3′ exerted by the springs 24 and to push the shaft 19 upwards towards the upper ends of the slots 23. During initial upward movement of the shaft 19 the stripper element 3, which is still acted on by the spring 20, is caused to pivot counterclockwise about the tip 4 thereof, with the result that the rounded extension 5 is rapidly brought into contact with the roll 1.

After this, as the shaft 19 continues to be moved upwards the stripper element 3 is pivoted about the rounded portion 5, whereby the tip 4 is moved out of contact with the roll 1, as shown in FIG. 2(*c*). When this happens, the frictional force F, and hence the component *f*3 thereof, of course disappears, but the leading edge of the copy paper 12 still contacts the tip 4 and still exerts a force acting along a line which coincides with or is very close to the line of action of the frictional force F, and there is therefore continued application of a force in the direction of the component *f*3, and the shaft 19 continues to be moved upwards, the roll 1 being now contacted only by the rounded extension 5 which creates no risk of damage to the roll 1.

Needless to say, the stripper element 3 as a whole is made of a material which is not liable to damage the roll 1, and the rounded extension 5 may therefore be made of the same material and be integral with the rest of the stripper element 3. Alternatively, however, the extension 5, which is not required to be in constant contact with the roll 1, may be made of a material which is much softer than the rest of the stripper element 3.

The action of the means of the invention occurs as described above even if the entire surface of a sheet of copy paper 12 becomes adhered to the heating roll 1. However, as is known, it is very unusual for the entire surface of copy paper 12 to adhere to the heating roll 1, but normally if copy paper becomes stuck only the leading edge portion thereof becomes stuck, and the remaining portion of the copy paper may be freely or easily detached from the heating roll periphery. In this case, with the means of the invention there is the added advantage that the trailing portion of the copy paper 12 piles up in folds in the photocopying machine area adjacent to the exit of the rolls 1 and 2, and the folds of the copy paper 12 act to further increase the upwardly acting force P, so resulting in even more rapid movement of the stripper element tip 4 out of contact with the heating roll 1.

Thus, the stripper means of the invention meets the objects of avoiding undue pressure on the heating roll during normal functioning of the photocopying machine, and also preventing damage to the heating roll or stripper means even if a paper jam occurs.

The stripper element 3 preferably includes the rounded extension 5 in order to effect rapid movement of the tip 4 out of contact with the roll 1. However, even if the extension 5 is not included, the above-described upward movement of the shaft 19 brings the stripper element 3 into an alignment wherein the upper surface of the main body portion 3*a* to the rear of the tip 4 slides against the roll 1, and direct pressure on the roll 1 by the tip 4 is avoided.

Needless to say, the same results are achieved if the stripper elements 3 are fixedly attached to the support shaft 19 and the shaft 19 is rotatable in the slots 23. In this case, since the force exerted by the wire springs 20 also has a horizontal component, the wire springs also act to press the shaft 19 against the sides of the slots 23 and thus hold the shaft 19 in a normal position contacting the lower ends of the slots 23, and if wire springs 20 having a suitable strength are employed the springs 24 may be dispensed with.

Referring back to FIG. 1, when the support shaft 19 reaches the upper ends of the slots 23, it presses the lever 27, thus actuating the switch 26 and the above-mentioned alarm, which may be in the form of a buzzer or externally provided indicator lamp, for example, and serves to notify a user of the photocopying machine that copy paper is jammed at the location of the fuser assembly.

Referring now to FIGS. 3*a*–3*c*, there is shown another embodiment of the invention which has a simpler design and which employs a stripper element 3′ having generally the same external profile as in a support portion in the form of an above-described stripper element 3 but differing therefrom in that in the upward extension 18 thereof there is defined a slot 14, through which passes a fixed shaft 15. One end of a compression spring 16 is attached to a rear-end portion of the stripper element main body portion 3*a*′. The other end of the spring 16 is attached to a fixed portion of the photocopying machine interior, which is forward of, i.e., nearer the rolls 1 and 2, and lower than the location of the rear portion of the stripper element main body portion 3*a*′. The spring 16 therefore acts to simultaneously pull and pivot the stripper element 3′ into a normal position wherein, as shown in FIG. 3(*a*), the upper end of the slot 14 in the upward extension 18 of the stripper element 3′ contacts the fixed shaft 15 and the tip 4 of the stripper element 3′ contacts the periphery of the heating roll 1. The fixed shaft 15, which thus normally constitutes the pivotal center of the stripper element 3′, is located between the periphery of the roll 1 and the line of action of the frictional force F produced between the roll 1 and stripper element tip 4, thus achieving the above-described advantage of avoidance of excessive pressure on the roll 1.

In FIGS. 3(*a*) and 3(*b*), the frictional force F may again be regarded as being divided into components *f*1 and *f*2, and component *f*1 as being divided into components *f*3 and *f*4, component *f*3 acting vertically upwards and exerting a force which tends to move the stripper element 3′ upwards past the shaft 15. This component *f*3 is normally countered by the vertical downward component *f*3″ of the force exerted by the spring 16.

If, however, a sheet of copy paper 12 becomes firmly attached to the roll 1, the action is the same as described above, the component *f*3″ of the force exerted by the spring 16 is overcome, and the stripper element 3′ is moved upwards to a position in which the lower end of the slot 14 in the upward extension 18 thereof contacts the fixed shaft 15, in which position the stripper element tip 4 is out of contact with the roll 1, as shown in FIG. 3(*c*).

Referring to FIGS. 4*a* and 4*b*, since copy paper 12 may remain in attachment to either the heating roll 1 or the press roll 2, there is provided according to another embodiment of the invention one or more stripper elements 3, which may be either of the types described above, in association with the press roll 2 as well as with the heating roll 1. In this case, as shown in FIG. 4(*b*), if the leading edge portion of a sheet of copy paper 12 becomes firmly adhered to either the heating roll 1 or the press roll 2, the upper and lower strip elements 3 confine the remainder of the copy paper 12 which piles up at the exit side of the rolls 1 and 2 as the rolls 1 and 2 continue to rotate whereby the pressure P tending to cause upward or downward movement and pivoting of the stripper elements 3 is increased, and the tips 4 of the stripper elements are therefore moved more rapidly out of contact with the rolls 1 and 2.

Referring now to FIG. 5, there is shown another embodiment of the invention wherein there are provided in association both with the heating roll 1 and with the press roll 2 stripper elements 3 which are mounted on upwardly and downwardly movable shafts 19 in the manner described in reference to the first embodiment, and have tip portions designed to further reduce pressure liable to push the stripper elements 3 into unnecessary contact with the roll 1 or 2. Considering the stripper elements 3 associated with the heating roll 1, the tip portion of each stripper element 3 comprises an outer edge portion which actually contacts the periphery of the roll 1 and is defined by an inner surface which is in direct continuation to the inner, with respect to the roll 1, surface of the main body portion 3*a* of the stripper element 3 and has angled portions the angles of the portions relative to the outer surface increasing the further the portion is from the tip portion, and by an outer surface portion which is at an angle to and stepped outwardly from the outer surface of the stripper element main body portion. The construction of the stripper element 3 associated with the press roll 2 is the same, except that of course it is upside down.

In the normal position of each stripper element 3, the outer surface portion of the tip 4 thereof is generally in line with a copy paper guide 28 and the junction of feed-out rolls 29 which rotate simultaneously with the rolls 1 and 2 and serve to direct copy paper 12 to a subsequent stage or to the exterior of the photocopying machine. Thus, as a sheet of copy paper 12 is being detached from the roll 1 or the roll 2, the only portions of stripper elements 3 contacted by the copy paper 12 are the outer surface portions of the tips 4 thereof, and since these stepped-off portions are short, pressure exerted by the copy paper 12 tending to push the stripper elements 3 into contact with the roll with which they are associated is less, in addition to which, when copy paper 12 is being stripped from the heating roll 1, there is less contact between the stripper elements 3 and toner-carrying portion of the copy paper 12, and hence less possibility of removal of toner particles by the stripper elements 3.

In FIG. 6, since the above described means achieves reduction of the pressure pushing stripper element tips 4 into contact with fuser assembly roll means, the stripper elements 3 as seen in plan view, can have narrowed tip profiles, as shown in FIG. 6(*a*), or rounded tip profiles, as shown in FIG. 6(*b*), thereby ensuring improved efficiency of copy paper detachment.

Needless to say, while the invention has been described above in reference to several preferred embodiments thereof, the invention is not confined to the details described above, and the scope thereof should therefore be determined by the attached claims.

What is claimed is:

1. In a photocopying machine wherein a sheet of copy paper carrying toner particles defining the image of an original document is passed between a heating roll and a press roll constituting a fuser assembly, whereby said toner particles are fused and fixed in position, copy paper stripping means comprising:

at least one stripper element having a tip portion for contacting the peripheral surface of one of said rolls for effecting detachment of copy paper from said roll;

mounting means for freely rotatably mounting said stripper element about a center of rotation thereof for rotational movement relative to said roll and for movement of said center of rotation in a direction at least partly toward and away from the roll means, and normally positioning the center of rotation of said stripper element in an area intermediate the periphery of said roll and a plane which is tangential to the periphery of the roll at the line of contact thereof with said tip portion of said stripper element; and force application means for exerting a force on said stripper element and acting in a first direction and urging said stripper element when it is in the normal position of the center of rotation toward a position wherein said tip portion thereof contacts said roll, said mounting means accommodating movement of said stripper element to a position wherein said tip portion thereof is out of contact with said roll when said stripper element is subjected to a supplementary external force which is greater than said force acting in said first direction and exerted by said force application means.

2. Copy paper stripping means as claimed in claim 1 wherein said mounting means has a positioning means on which said stripper element is rotatably mounted and said positioning means is movable relative to said roll, and said mounting means further has guide means guiding said positioning means towards the periphery of said roll upon application of said supplementary force, whereby said tip portion of the stripper element retracts immediately from the peripheral surface of the roll upon application of the supplemental force.

3. Copy paper stripping means as claimed in claim 1 wherein said mounting means has a positioning means which is fixed relative to said roll, said stripper element being mounted on said positioning means for rotary and sliding motion relative to said positioning means, and said stripper element having a support portion having a guide means as a part thereof for guiding said stripper element toward said roll upon application of said supplementary force, whereby said tip portion of the stripper element retracts immediately from the peripheral surface of the roll upon application of the supplemental force.

4. Copy paper stripping means as claimed in claim 1 wherein said positioning means is a fixed shaft and said stripper element has a support portion having an elliptical slot therein through which said shaft extends and constituting said guide means.

5. Copy paper stripping means as claimed in claim 1, which further comprises a normally unactuated switch means which is actuated upon said movement of said stripper element caused by application of said supplementary force, and an alarm means connected to said switch means which is actuated upon actuation of said switch means.

6. In a photocopying machine wherein a sheet of copy paper carrying toner particles defining the image of an original document is passed between a heating roll and a press roll constituting a fuser assembly, whereby said toner particles are fused and fixed in position, copy paper stripping means comprising:

at least one stripper element having a tip portion for contacting the peripheral surface of one of said rolls for effecting detachment of copy paper from said roll;

mounting means for freely rotatably mounting said stripper element about a center of rotation thereof for rotational movement relative to said roll and for movement of said center of rotation in a direction at least partly toward and away from the roll means, and normally positioning the center of rotation of said stripper element in an area intermediate the periphery of said roll and a plane which is tangential to the periphery of the roll at the line of contact thereof with said tip portion of said stripper element; and force application means for exerting a force on said stripper element and acting in a first direction and urging said stripper element when it is in the normal position of the center of rotation toward a position wherein said tip portion thereof contacts said roll, said mounting means accommodating movement of said stripper element to a position wherein said tip portion thereof is out of contact with said roll when said stripper element is subjected to a supplementary external force which is greater than said force acting in said first direction and exerted by said force application means, said stripper element having a projection thereon which is brought into contact with the periphery of said roll means for acting as a pivot for pivotal movement of said stripper element during said application of said supplementary force.

7. In a photocopying machine wherein a sheet of copy paper carrying toner particles defining the image of an original document is passed between a heating roll and a press roll constituting a fuser assembly, whereby said toner particles are fused and fixed in position, copy paper stripping means comprising:

at least one stripper element having a tip portion for contacting the peripheral surface of one of said rolls for effecting detachment of copy paper from said roll;

a shaft on which said stripper element is freely rotatably mounted about a center of rotation thereof for rotational movement relative to said roll, said shaft extending in a line generally parallel to the rotary axis of said roll means, said photocopying machine having aligned slots extending at least partly toward and away from the periphery of the said roll and in which opposite ends of said shaft are slidably and rotatably supported, said shaft being normally positioned in said slots for positioning the center of rotation of said stripper element in an area intermediate the periphery of said roll and a plane which is tangential to the periphery of the roll at the line of contact thereof with said tip portion of said stripper element; and force application means for exerting a force on said stripper element and acting in a first direction and urging said stripper element when it is in the normal position of the center of rotation toward a position wherein said tip portion thereof contacts said roll and said shaft being movable in said slots to move said stripper element to a position wherein said tip portion thereof is out of contact with said roll when said stripper element is subjected to a supplementary external force which is greater than said force acting in said first direction and exerted by said force application means.

8. In a photocopying machine wherein a sheet of copy paper carrying toner particles defining the image of an original document is passed between a heating roll and a press roll constituting a fuser assembly, whereby said toner particles are fused and fixed in position, copy paper stripping means comprising:

at least one stripper element having a tip portion for contacting the peripheral surface of one of said rolls for effecting detachment of copy paper from said roll, said tip portion having a stepped portion on the outer surface of the end portion of said stripper element, and the outer edge portion of said tip portion normally contacting said roll means being narrowed with respect to the remainder of the tip portion;

mounting means for freely rotatably mounting said stripper element about a center of rotation thereof for rotational movement relative to said roll and for movement of said center of rotation in a direction at least partly toward and away from the roll means, and normally positioning the center of rotation of said stripper element in an area intermediate the periphery of said roll and a plane which is tangential to the periphery of the roll at the line of contact thereof with said tip portion of said stripper element; and force application means for exerting a force on said stripper element and acting in a first direction and urging said stripper element when it is in the normal position of the center of rotation toward a position wherein said tip portion thereof contacts said roll, said mounting means accommodating movement of said stripper element to a position wherein said tip portion thereof is out of contact with said roll when said stripper element is subjected to a supplementary external force which is greater than said force acting in said first direction and exerted by said force application means.

9. A photocopying machine comprising:

a movable element for transferring a sheet of copy paper carrying the image of an original document with the sheet of copy paper in contact therewith;

copy paper stripping means having a tip portion for separating the sheet of copy paper from the outer peripheral surface of said movable element;

positioning means on which said stripping means is freely rotatably mounted and for controlling the position of said stripping means relative to the peripheral surface of said movable element, said stripper element being movable toward and away from the peripheral surface of said movable element, said positioning means normally constituting the rotary center of said stripping means and being located in an area intermediate the periphery of said movable element and a plane which is tangential to the peripheral surface of said movable element at the line of contact thereof by said tip portion of said stripping means;

force application means for exerting a force on said stripping means acting in a first direction and urging said stripping means into a position wherein said tip portion thereof contacts said movable element; and guide means for guiding said stripping means toward said movable element to a position wherein said tip portion thereof is out of contact with said movable element when said stripping means is subjected to a supplementary external force which is greater than said force acting in said first direction and exerted by said force application means;

said stripping means having a projection thereon which is brought into contact with the peripheral surface of said movable element for acting as a pivot center for pivotal movement of said stripping means when said supplementary force moves said positioning means toward said movable element.

10. A photocopying machine as claimed in claim 9, wherein said positioning means is fixed relative to said movable element, said stripping means is rotatably movable and slidable with respect to said positioning means, and said guide means comprises means on said stripping means for guiding said stripping means towards said movable element periphery upon application of said supplementary force.

11. A photocopying machine as claimed in claim 9, wherein said positioning means is constituted by a shaft extending in a line generally parallel to the peripheral surface of said movable element, and said guide means is constituted by fixed wall portions of said photocopying machine having generally vertically aligned slots therein and in which opposite ends of said shaft are slidably and rotatably supported.

12. A photocopying machine as claimed in claim 10, wherein said positioning means is constituted by a fixed shaft and said guide means is constituted by a portion on said stripping means having an elliptical slot through which said shaft extends.

13. A photocopying machine as claimed in claim 9, which further comprises a normally unactuated switch means which is actuated upon said movement of said stripping means caused by application of said supplementary force, and an alarm means connected to said switch means which is actuated upon actuation of said switch means.

14. A photocopying machine as claimed in claim 9, wherein said tip portion of said stripping means has a stepped portion on the outer surface of the end portion of said stripping means, and the outer edge portion of said tip portion normally contacting said movable element is narrowed with respect to the remainder of the tip portion.

* * * * *